US005307579A

United States Patent [19]

Clayton et al.

[11] Patent Number: 5,307,579

[45] Date of Patent: May 3, 1994

[54] ELECTROSTATIC AND MAGNETIC HOLDER

[75] Inventors: Theodore H. Clayton, Tipton; Douglas F. Smith, Tecumseh, both of Mich.

[73] Assignee: Static-Mag Inc., Tecumseh, Mich.

[21] Appl. No.: 944,093

[22] Filed: Sep. 11, 1992

[51] Int. Cl.[5] ..... G09F 7/04

[52] U.S. Cl. ..... 40/600; 40/611

[58] Field of Search ..... 40/594, 618, 611; 24/306, 303, 563

[56] References Cited

U.S. PATENT DOCUMENTS

| | | | |
|---|---|---|---|
| 3,440,750 | 4/1969 | Toth et al. | 40/618 |
| 3,924,879 | 12/1975 | Wright | 40/594 |
| 4,992,121 | 2/1991 | Rudino | 40/494 |

*Primary Examiner*—Kenneth J. Dorner
*Assistant Examiner*—Cassandra Davis
*Attorney, Agent, or Firm*—Beaman & Beaman

[57] ABSTRACT

An electrostatic and magnetic holder for paper, signs and the like wherein the holder is mounted upon glass or similar dielectric surfaces by electrostatic attraction. The holder includes an electrostatically attractable flexible base, and a folded clip section also preferably formed of flexible electrostatic material which is attached to the base either by electrostatic attraction, heat sealing or an adhesive. The clip section includes a pair of opposed magnets, one of the magnets being mounted upon a movable flap whereby the magnets may move relative to each other, and a thin article such as paper, or paper signs, may be gripped between the magnets for support by the holder.

10 Claims, 1 Drawing Sheet

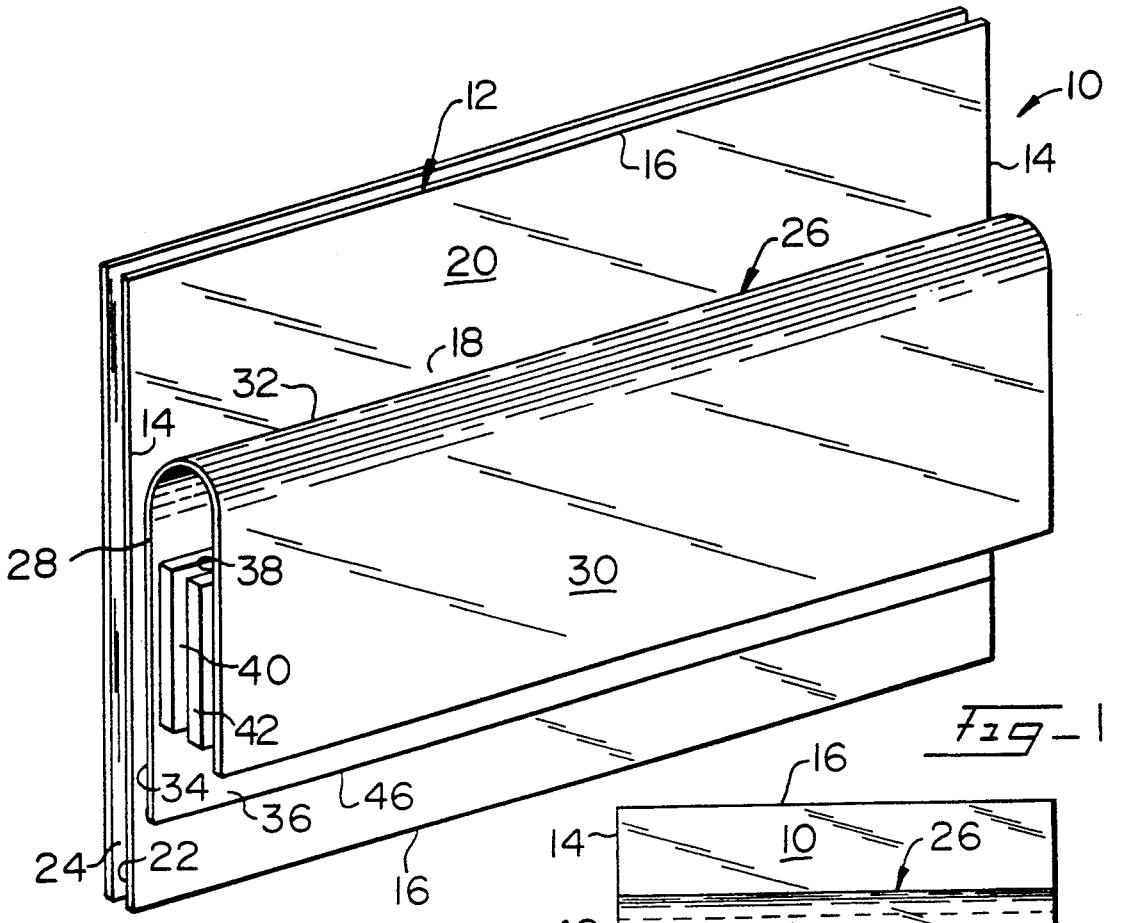
Fig-1
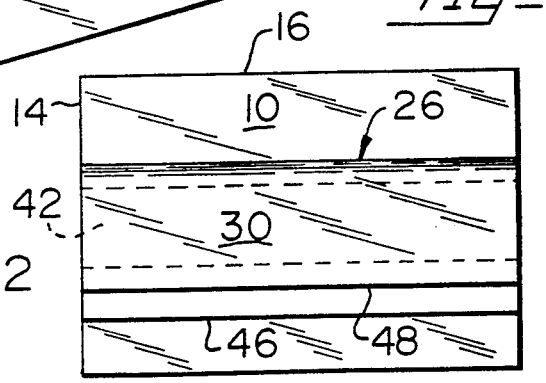
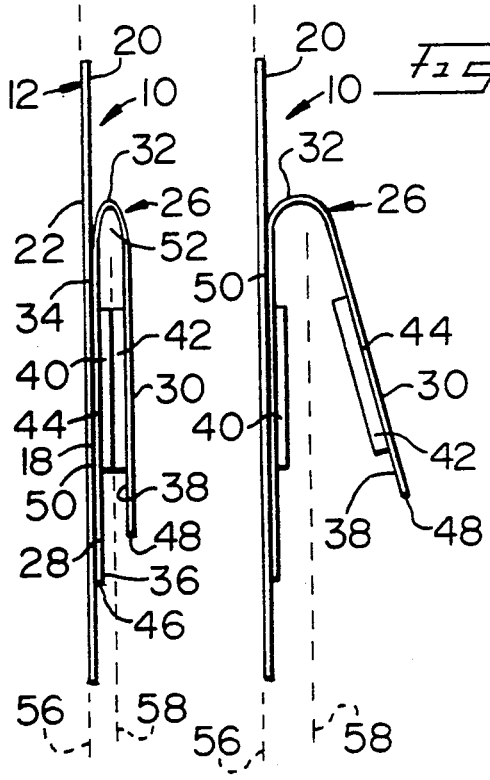
Fig-2
Fig-3
Fig-4
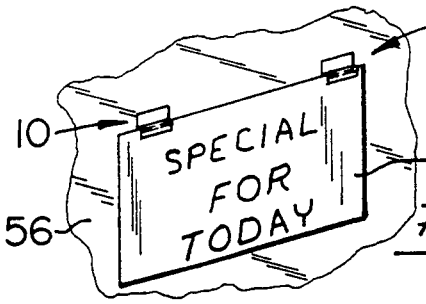
Fig-5
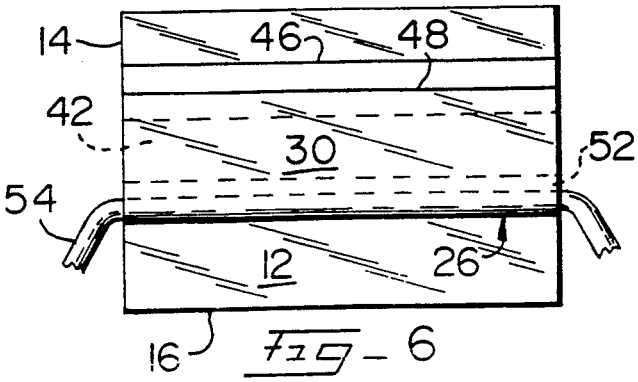
Fig-6

ELECTROSTATIC AND MAGNETIC HOLDER

BACKGROUND OF THE INVENTION

1. Field of the Invention

The invention pertains to article holders, particularly paper and paper sign holders, electrostatically supported upon glass or similar dielectric material by electrostatic force, the holder including a pair of relatively displaceable magnets between which the paper is held by magnetic force.

2. Description of the Related Art

Signs and banners, such as paper signs, are usually mounted within store windows by tape. The use of tape to support window signs is unsightly, the tape is often very difficult to remove from the glass, and there is a need for holders for paper signs and the like which does not require tape.

Electrostatic forces have been used in conjunction with display devices, such as shown in U.S. Pat. No. 4,741,119. Also, it is also known to use magnetic forces with articles and signs wherein magnets are employed to directly or indirectly support the sign, such as shown in U.S. Pat. Nos. 2,815,595; 4,222,489; 4,255,837; 4,475,300 and 4,703,575. However, the devices shown in these patents are expensive, somewhat difficult to use, and have not found ready commercial acceptance.

An inexpensive sign holder which is attached to a glass window or other supporting surface by a pressure sensitive adhesive is shown in U.S. Pat. No. 4,258,493. However, sign holders using adhesives have the disadvantage of being permanently affixed at a predetermined location on the window making the holder only suitable with particular sizes of signs, and where an adhesive is used to attach the holder to the glass unsightly deposits on the glass may remain after the sign holder is removed, and once the holder is used it cannot be easily reused.

SUMMARY OF THE INVENTION

Objects of the Invention

It is an object of the invention to provide an article holder particularly suitable for holding paper signs in windows using electrostatic forces and magnetic forces wherein an economical sign holder may be fabricated of low cost materials.

An additional object of the invention is to provide a sign holder using electrostatic and magnetic forces wherein the sign holder may be readily located upon its supporting surface, such as a glass window, may be readily relocated and reused, and wherein no residue or marks are deposited upon the supporting surface due to the attachment of the sign holder.

Yet another object of the invention is to provide a sign holder utilizing electrostatic and magnetic forces wherein the sign holder is attractive, may be used by persons of ordinary skill, requires no tape or similar ancillary components, and is attractive and dependable in operation.

In the practice of the invention, the sign holder basic member comprises a base of flexible electrostatic sensitive and attractable material, such as static cling vinyl, which is of a flexible film construction and will readily adhere to dielectric surfaces such as window glass. Preferably, the base is of a rectangular configuration having a central region located between upper and lower edges.

The article holding clip section of the holder consists of a body or section of flexible material, preferably static cling vinyl, which is attached to the base central region either by electrostatic force, heat sealing or an adhesive. The clip section includes a backing portion attached to the base, and a flap portion hinged to the backing portion by the flexible nature of the clip material. Elongated magnets are affixed to the inner faces of the backing and flap portions in opposed relationship whereby the article to be clamped, such as a sheet of paper or sign, may be located between the magnets and gripped thereby by the magnetic attraction between the magnets. The magnets are adhesively bonded to the inner faces of the backing and flap portion.

By utilizing a base of relatively large area, the base may be firmly electrostatically attached to a window or other dielectric smooth surface. In this manner, the magnet clip will be supported so as to hold a paper or sign. The base may be easily removed from the window, or relocated thereon, without leaving a residue on the window, and as the clip flap portion may be readily lifted to separate the magnets, paper may be easily inserted between the magnets, or released from their gripping force.

An electrostatic article holder in accord with the invention may be economically manufactured, can be formed of attractive colors, or be substantially transparent, and provides an article holder achieving the aforedescribed objects of the invention.

BRIEF DESCRIPTION OF THE DRAWINGS

The aforementioned objects and advantages of the invention will be appreciated from the following description and accompanying drawing wherein:

FIG. 1 is a perspective exploded view of an electrostatic and magnetic holder in accord with the inventive concepts, FIG. 2 is a front elevational view of the holder, FIG. 3 is an end elevational view of the holder with the magnets in the paper holding relationship, FIG. 4 is an end elevational view illustrating the clip flap portion in an open position for receiving or releasing paper, FIG. 5 is a reduced scale perspective illustration of the manner in which the holder of the invention may be employed in conjunction with a store window, and FIG. 6 is a elevational view illustrating the holder being installed in an inverted position for use with a banner loop or the like.

DESCRIPTION OF THE PREFERRED EMBODIMENT

An electrostatic and magnetic holder in accord with the invention is generally represented at 10 in the drawings, and includes a rectangular base 12. The base 12 is formed of a flexible electrostatically chargeable material such as static cling vinyl and includes ends 14 and parallel lateral sides 16. A central region 18 is defined between the sides 16, and the base 12 includes an outer face 20 and an inner face 22.

Preferably, a protective shield 24 is adhered to the base inner face 22 to keep the face 22 clean and free of foreign matter during shipping and handling. The protective shield 24 may be formed of thick paper or the like having a wax or plastic surface whereby the electrostatic forces between the shield 24 and base face 22 will maintain the shield 24 firmly against the face 22, and yet, the shield 24 may be readily peeled from the base surface. The protective shield 24 is removed from the base face 22 prior to the article holder 10 being used.

A clip designated 26 is attached to the base central region 18 to the outer face 20. The clip 26 consists of a section of a flexible electrostatic attractable material such as static cling vinyl and includes a backing portion 28 and a flap portion 30, these portions being interconnected by a flexible hinge portion 32 wherein the flap portion 30 may be "pivotably" positioned relative to the back portion 28 between open and closed positions as shown in FIGS. 3 and 4.

The backing portion 28 includes an outer face 34 and an inner face 36, while the flap portion 30 includes an inner face 38. An elongated rectangular magnet 40 is bonded to the back portion inner face 36, while a similarly sized magnet 42 is bonded to the flap portion inner face 38. The magnets are attached to their respective support surfaces by an adhesive 44 interposed between the magnets and the associated clip portions' inner faces.

As will be appreciated from the drawing, the backing portion lower edge 46 extends below the flap portion lower edge 48, and in this manner the portion of the flap portion between the magnet 42 and the edge 48 constitutes a deflectable handle which may be readily grasped by the user to raise the flap portion 30 to the open position shown in FIG. 4 wherein the magnets 40 and 42 are separated.

Because both the base 12 and the clip 26 are formed of a static cling vinyl the clip 26 may be attached to the base central region 18 solely by the electrostatic forces that exist between the base face 20 and the clip backing portion outer face 34. Such electrostatic forces between the base 12 and clip 26 are sufficient to achieve the desired assembly between these components.

However, in the preferred commercial embodiment an adhesive 50 is placed between the base outer face 20 and the clip backing portion outer face 34 to assure a firm mechanical assembly of the base 12 and clip 26. When the adhesive 50, or heat sealing, is used to interconnect the base 12 and clip 26, it is not necessary that the clip be formed of a static cling material, and could be formed of any flexible material which would permit the material to hinge at 32 and permit the magnets 42 and 44 to be engaged and separated.

To use the article holder 10, if the protective shield 24 has not been removed from the base inner face 22, the protective shield should be peeled therefrom to expose the base inner face 22 so that the face 22 may be firmly pressed against a supporting surface, such as glass window 56, FIG. 5, and the base may be "ironed" against the glass by the user's fingers to eliminate air bubbles and the like.

The electrostatic nature of the base 12 will cause the base 12 to be firmly attached to the glass 56 without the use of an adhesive, and yet it is possible to peel the base 12 from the glass 56 when it is desired to remove the article holder 10, or relocate the article holder upon the glass window.

Once the article holder 10 is attached to the glass supporting surface 56 the user grasps the flap portion 30 adjacent the lower edge 48 and raises the flap portion 30 as shown in FIG. 4 to separate the magnets 40 and 42. Thereupon a paper sign or the like, represented at 58, may be inserted between the magnets, and release of the flap portion 30 will permit the magnets 40 and 42 to be attracted toward each other firmly gripping the sign 58 as shown in FIG. 3. Of course, for the magnets to be attracted to each other, opposed magnet faces have opposite polarity.

To remove the sign 58 from between the magnets 40 and 42, it is only necessary to grasp the clip flap portion 30 adjacent the lower edge 48 and lift the flap portion as shown in FIG. 4.

The magnets 40 and 42 may be formed of a barium ferrite powder utilizing binder materials is as known. The adhesives 44 and 50 may constitute double sided acrylic tape, but other types of compatible adhesives may be used. Also, it is possible to heat seal the base 12 and the clip backing portion 28 together. The thickness of the material used to form the base 12 and the clip 26 usually range between seven and twelve mils.

It is impossible to use the article holder 10 of the invention to support a loop, such as may be formed on a banner or other article which cannot be readily grasped and held by the magnets 40 and 42. Such use of the article holder 10 is represented in FIG. 6. In such instance, the article holder orientation is reversed from its usual orientation such that the clip 26 "opens" upwardly. Because a space exists between the nearest sides of the magnets 40 and 42 and the hinge portion 32 a hinge loop cavity 52, FIG. 3, exists adjacent the hinge, and this lop may be used to receive the cord 54 of a banner or other article wherein the same may be suspended from the article holder 10. In such instance, the magnets 40 and 42 will be engaging each other, and the article holder 10 is capable of supporting considerable weight in this manner.

It will be appreciated that when supporting a sign, banner, or the like, the forces imposed upon the article holder 10 will be substantially parallel to the plane of the supporting surface, i.e. glass 56. Thus, primarily shear forces are interposed between the base 12 and the glass 56, and the electrostatic forces maintaining these components in engagement is sufficient to permit relatively high shear forces to be resisted without pulling the article holder from the surface of the glass 56. However, when removing the article holder 10 from the glass 56 by peeling a corner of the base 12 from the glass and pulling the base directly away from the glass the base 12 may be easily separated from the glass supporting surface.

All of the components of the article holder 10 are economically manufactured, and as the assembly techniques may be economically achieved an article holder 10 in accord with the inventive concepts is of a low cost. The material of the base 12 and clip 26 may be transparent as to permit the article holder to be unobtrusive, but if desired, the vinyl material may be brightly colored for aesthetic purposes.

It is appreciated that various modifications to the inventive concepts may be apparent to those skilled in the art without departing from the spirit and scope of the invention.

I claim:

1. An electrostatically supported article holder comprising, in combination, a base formed of a flexible electrostatically chargeable material having lateral sides, end edges and a central region intermediate said lateral sides, an article clip mounted on said base intermediate said lateral sides including a backing portion formed of electrostatically chargeable material engageable with said base said clip is selectively mounted upon said bas by electrostatic attraction, a front flag portion opposite said backing portion and means biasing said backing portion and said front portion toward each other to grip an article therebetween, said base permitting said article clip to be supported upon an electrostatically attractable surface.

2. In an electrostatically supported article holder as in claim 1 said means biasing said backing portion and said front flag portion toward each other comprising a magnetic force.

3. In an electrostatically supported article holder as in claim 1, said base being formed of static cling vinyl.

4. In an electrostatically supported article holder as in claim 1, said base and said backing portion being formed of static cling vinyl.

5. In an electrostatically supported article holder as in claim 1, said slip comprising a folded section of flexible material having said backing portion and said front flap portion, said portions each having an outer face and an inner face, said backing portion outer face being affixed to said base, and a magnet affixed to each of said inner faces of said backing and front flap portions, said magnets being in opposed engageable position to each other adapted to grip a thin non-magnetic article therebetween.

6. In an electrostatically supported article holder as in claim 5, said magnets being formed of barium ferrite powder.

7. In an electrostatically supported article holder as in claim 5, said clip folded section of flexible material comprises an electrostatically chargeable material whereby said backing portion outer face is electrostatically attached to said base.

8. In an electrostatically supported article holder as in claim 7, said base and clip section being formed of static cling vinyl.

9. An electrostatically supported article holder comprising, in combination, a base formed of an electrostatically chargeable material having lateral sides, end edges and a central region intermediate said lateral sides, an article clip mounted on said base having a backing formed of electrostatically chargeable material engageable with said base, said clip is selectively mounted upon said base by electrostatic attraction, opposed jaws defined on said clip and means biasing said jaws toward each other to grip an article between said jaws, said base permitting said article clip to be supported upon an electrostatically attractable surface.

10. An electrostatically supported article holder comprising, in combination, a base formed of an electrostatically chargeable material having lateral sides, end edges and a central region intermediate said lateral sides, an article clip mounted on said base having a backing portion formed of electrostatically chargeable material engageable with said base, said clip is selectively mounted upon said base by electrostatic attraction, a front flag portion and means biasing opposite said backing portion toward each other to grip an article said backing portion and said front flag portion therebetween, said base permitting said article clip to be supported upon an electrostatically attractable surface, said clip comprising a folded section of flexible material having said backing portion and said front flap portion interconnected to said backing portion by a homogeneous hinge, said portions each having an outer face and an inner face, said backing portion outer face being affixed to said base, and a magnet affixed to each of said inner faces of said backing and front flap portions, said magnets being in opposed engageable position to each other to maintain said hinge closed permitting said hinge to receive an article support member.

* * * * *

UNITED STATES PATENT AND TRADEMARK OFFICE

CERTIFICATE OF CORRECTION

PATENT NO. : 5,307,579

DATED : May 3, 1994

INVENTOR(S) : Theodore H. Clayton et al

It is certified that error appears in the above-indentified patent and that said Letters Patent is hereby corrected as shown below:

Column 4, line 65, "bas" should read -- base --.

Column 4, line 66, "flag" should read -- flap --.

Column 5, line 6, "flag" should read -- flap --.

Column 5, line 14, "slip" should read -- clip --.

Column 6, line 19, "flag" should read -- flap --.

Column 6, line 19, after "portion", insert -- opposite said backing portion --.

Column 6, line 19, delete "opposite".

Column 6, line 20, after "portion", insert -- and said front flap portion --.

UNITED STATES PATENT AND TRADEMARK OFFICE

CERTIFICATE OF CORRECTION

PATENT NO. : 5,307,579

DATED : May 3, 1994

INVENTOR(S) : Theodore H. Clayton et al

It is certified that error appears in the above-indentified patent and that said Letters Patent is hereby corrected as shown below:

Column 6, lines 20 and 21, delete "said backing portion and said front flag portion".

Signed and Sealed this

Thirteenth Day of September, 1994

*Attest:*

Bruce Lehman

BRUCE LEHMAN

*Attesting Officer*

*Commissioner of Patents and Trademarks*